US005253980A

United States Patent [19]

Nishioka et al.

[11] Patent Number: 5,253,980

[45] Date of Patent: Oct. 19, 1993

[54] AGITATING VANE

[75] Inventors: Shigeru Nishioka, Tokyo; Mikio Asai, Kawaguchi, both of Japan

[73] Assignee: Satake Chemikal Equipment Mfg., Ltd., Moriguchi, Japan

[21] Appl. No.: 905,824

[22] Filed: Jun. 29, 1992

[30] Foreign Application Priority Data

Oct. 28, 1991 [JP] Japan ..... 3-095902

[51] Int. Cl.[5] ..... B01F 7/16

[52] U.S. Cl. ..... 416/231 A; 416/227 R; 416/237

[58] Field of Search ..... 416/227 R, 227 A, 231 A, 416/235, 237; 366/325, 328, 329, 343

[56] References Cited

U.S. PATENT DOCUMENTS

| | | | |
|---|---|---|---|
| 956,367 | 5/1910 | Massie | 416/231 A |
| 1,344,496 | 6/1920 | Flattum | 416/227 A |
| 2,103,243 | 12/1937 | Bradford, Jr. | 416/227 A |
| 3,156,359 | 11/1964 | Stiffler | 416/237 |
| 3,280,764 | 10/1966 | Potter et al. | 366/98 |
| 3,630,636 | 12/1971 | Hill | 416/231 A |
| 3,977,655 | 8/1976 | Okabayashit et al. | 366/325 |

*Primary Examiner*—Edward K. Look
*Assistant Examiner*—Michael S. Lee
*Attorney, Agent, or Firm*—Oblon, Spivak, McClelland, Maier & Neustadt

[57] ABSTRACT

An agitating vane in which a plate-like vane is disposed at an extreme end of a rotary shaft to agitate liquid has a feature that auxiliary vanes for covering a part of vane with a clearance being left are disposed in front of the surface of the vane in its rotational direction. Accordingly, a phenomenon of peeling-off caused by the eddy flow generated at the rear surface of the vane is eliminated by liquid flowing at a high speed at a clearance between the vane and the auxiliary vanes, a circulation flow of regulated flow state is attained and agitating efficiency is improved.

5 Claims, 1 Drawing Sheet

AGITATING VANE

BACKGROUND OF THE INVENTION

1. Field of the Invention

This invention relates to agitating vanes for use in agitating liquid in food industries or chemical industries or the like.

2. Description of the Related Art

Known agitating vanes of this type were provided with flat plate-like vanes fixed to an end part of a rotary shaft.

Such conventional agitating vanes had some disadvantages in that liquid is pushed out to the outer edges of the vanes during rotation of the vanes, a negative pressure is generated at the rear portions of the vanes, the liquid is sucked to generate eddy flows so that a uniform circulation can hardly be generated in the tank and uniform agitation of the liquid is not easily carried out.

SUMMARY OF THE INVENTION

It is an object of the present invention to improve circulating characteristics and agitating efficiency by restricting the occurrence of eddy flow, eliminating any peeling-off of the liquid and regulating the flow.

In order to achieve the aforesaid objects, the present invention has a feature that auxiliary vanes for covering a part of the surfaces of vanes of plate members, with a spacing being left between the surfaces, are provided in front of the vanes, i.e., upstream in their rotating direction.

BRIEF DESCRIPTION OF THE DRAWINGS

Various other objects, features and attendant advantages of the present invention will be more fully appreciated as the same becomes better understood from the following detailed accompanying drawings in which like reference characters designate like or corresponding parts throughout the several views and wherein.

DESCRIPTION OF THE PREFERRED EMBODIMENTS

Figure 1:
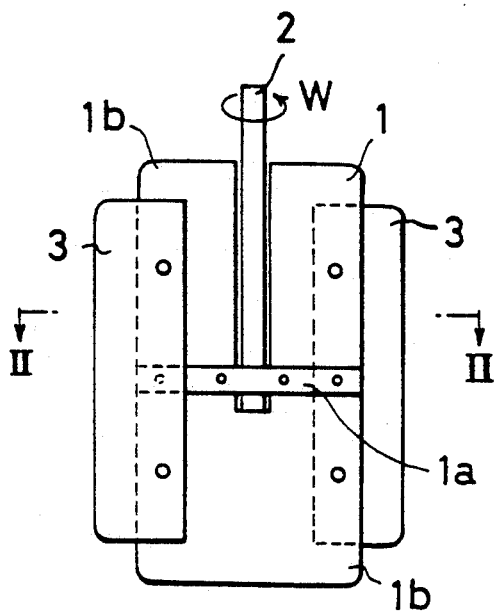
FIG. 1 is a front elevational view for showing the first preferred embodiment of the present invention.
Figure 3:
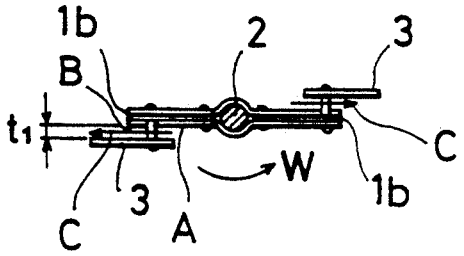
FIG. 3 is a sectional view taken along a line II—II of FIG. 1.

Referring now to FIGS. 1 and 3, the first preferred embodiment of the present invention will be described.

Reference numeral 1 denotes a vane. The vane 1 is comprised of a flat plate and is fixed to a lower end of a rotary shaft 2 by a stopper plate l*a*.

Reference numerals 3 denote auxiliary vanes. The auxiliary vanes 3 are composed of flat plates slightly shorter and narrower than the vane 1, and the auxiliary vanes project outwardly from the side edges 1*b* of the vane 1. The auxiliary vanes have a clearance $t_1$ from the vane 1, are parallel with the vane 1 and are supported at an upstream or front surface in a rotational direction.

Operation of the aforesaid first preferred embodiment will now be described.

As the vane 1 is rotated in a direction indicated by an arrow W, a liquid pressure is increased by the liquid striking against the vane 1 at a front surface A of the vane 1 at locations where the auxiliary vanes 2 are not present, the liquid pressure is decreased at the front surface B of the vane 1 where the auxiliary vanes 3 are present. This liquid pressure differential creates a high speed flow along the front surface of the vane 1 from A to B. Peeling-off caused by the eddy flow generated at the side edges of a rear surface of the vane 1 due to a previous rotation of the vane 1 is thus eliminated by this high speed flow, resulting in that the liquid becomes a smooth circulation flow to improve agitating efficiency.

Figure 2:
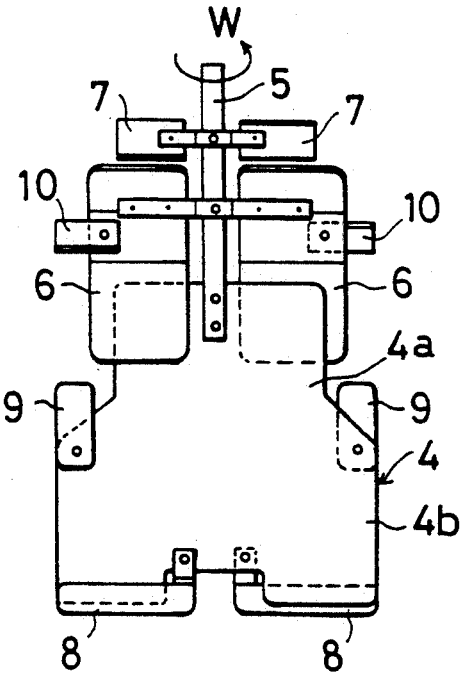
FIG. 2 shows a front elevational view for showing the second preferred embodiment of the present invention.
Figure 4:
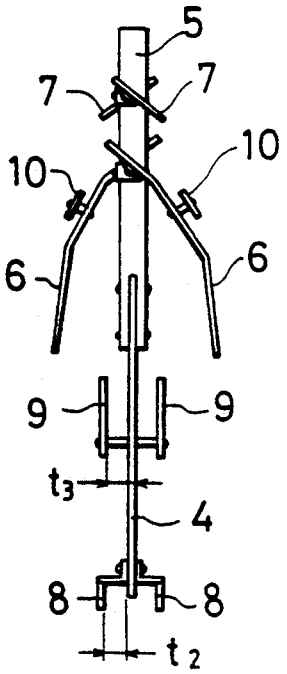
FIG. 4 is a side elevational view of FIG. 2.

FIGS. 2 and 4 illustrate the second preferred embodiment of the present invention. In the second preferred embodiment, reference numeral 4 denotes a vane whose width is narrower at the upper part 4*a* and wider at the lower part 4*b*. The vane 4 is fixed to the end part of the rotary shaft 5.

Reference numerals 6 denote large slant upper auxiliary vanes bent in a T-shape. That is, these auxiliary vanes 6 have upper ends mounted to the rotary shaft 5 and extend downward with a transverse crease along their length to provide the bent shape. The upper auxiliary vanes 6 are disposed above the vane 4 and at the same time they are projected in mutually opposite rotational directions.

Reference numerals 7 and 10 denote small vanes. The small vanes 7 and 10 are respectively positioned above and at an intermediate part of the upper auxiliary vanes 6 and have slant surfaces inclined in the same direction as that of the corresponding upper auxiliary vanes 6.

Reference numerals 8 denote lower auxiliary vanes. The lower auxiliary vanes 8 are comprised of belt-like plate members, parallel with the vane 4 and projected downwardly. They have a clearance ($t_2$) with respect to the vane 4.

Reference numerals 9 denote intermediate auxiliary vanes. The intermediate auxiliary vanes 9 are comprised of belt-like plates, parallel with the vane 4 and have a clearance ($t_3$) with respect to the vane 4.

In the second preferred embodiment, an upper high speed flow is generated by large upper auxiliary vanes 6 during rotation W of the rotary shaft 5 so as to eliminate any peeling-off caused by an eddy flow generated at an upper part of the rear surface of the vane 4 in a previous rotation. Any peeling-off caused by the eddy flow at the side of an intermediate part and near the lower end of the vane 4 is eliminated by the intermediate auxiliary vanes 9 and the lower auxiliary vanes 8 in the same manner as that at the upper part of the vane 4. As a whole, a circulating flow accompanied by an ascent of liquid at a central part of the tank and a descent of liquid around the tank periphery is generated so as to improve agitating efficiency. In addition, the small vanes 7 and 10 generate a regulated flow at the front surface of the upper auxiliary vanes 8 and eliminate any peeling-off caused by eddy flows generated at the rear surfaces of the upper auxiliary vanes 8.

Fixing position, clearance and size of the auxiliary vanes can be optionally modified.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An agitating vane comprising:

a rotary shaft, a plate-like vane arranged at an extreme end of a rotary shaft to agitate a liquid, a plane of said plate-like vane extending substantially parallel to a rotational axis of said rotary shaft so that one surface of said plate-like vane faces upstream in a rotational direction; and auxiliary vanes covering a part of the upstream surface of said plate-like vane, with a clearance being left between the upstream surface and the auxiliary vanes.

2. An agitating vane according to claim 1 wherein said auxiliary vanes are disposed adjacent a radially outer part of said plate-like vane.

3. An agitating vane according to claim 1 wherein said auxiliary vanes are comprised of an upper auxiliary vane, an intermediate auxiliary vane and a lower auxiliary vane respectively disposed at an upper end of said plate-like vane, an intermediate position at a side of said plate-like vane, and a lower end of said plate-like vane.

4. An agitating vane according to claim 3 wherein said upper auxiliary vane has an upper end mounted to the rotary shaft and is bent at a transverse crease with a lower end of the upper auxiliary vane extending in an upstream direction relative to the plate-like vane.

5. An agitating vane according to claim 4 including inclined small vanes are above said upper auxiliary vane and inclined in the same direction as that of said upper auxiliary vane and place with a clearance from the upper auxiliary vane.

* * * * *